US005178383A

United States Patent [19]

Moser et al.

[11] Patent Number: 5,178,383

[45] Date of Patent: Jan. 12, 1993

[54] METHOD OF SEPARATING SHEETS

[75] Inventors: James R. Moser, Easton; Gerald D. Warden, Bethlehem; Thomas E. Bieber, Coplay, all of Pa.

[73] Assignee: Bell & Howell Phillipsburg Company, Skokie, Ill.

[21] Appl. No.: 888,280

[22] Filed: May 26, 1992

Related U.S. Application Data

[60] Continuation of Ser. No. 686,363, Apr. 17, 1991, abandoned, which is a division of Ser. No. 401,743, Sep. 1, 1989, Pat. No. 5,025,609.

[51] Int. Cl.[5] ..... B65H 37/10

[52] U.S. Cl. ..... 271/299; 198/457; 198/458; 271/69; 271/189; 271/198; 414/789

[58] Field of Search ..... 414/789

[56] References Cited

U.S. PATENT DOCUMENTS

| | | | |
|---|---|---|---|
| 1,792,623 | 2/1931 | Willsea | 271/299 X |
| 2,745,538 | 5/1959 | Lamb | 271/299 X |
| 3,529,711 | 9/1970 | Moeller | 198/457 X |
| 3,860,232 | 1/1975 | Martin | 271/299 X |

FOREIGN PATENT DOCUMENTS

| | | | |
|---|---|---|---|
| 388090 | 9/1962 | Switzerland | 271/299 |

*Primary Examiner*—H. Grant Skaggs
*Assistant Examiner*—Carol Lynn Druzbick
*Attorney, Agent, or Firm*—Millen, White, Zelano & Branigan

[57] ABSTRACT

A method for in-plane separation of side-by-side parallel sheet articles that are transported along mutually-laterally-adjacent, in-plane paths, the method comprising: feeding unconnected sheet articles parallel to one another to mutually divergent belt arrangements that are driven at the same speed; conveying the sheet articles in a common plane divergently in relation to one another through the divergent belt arrangements and thereby irrotationally separating the sheet articles in the common plane and conveying the articles to a transporter; transporting the sheet articles and selectively stopping them by and in collectors of the transporter; collecting the selectively-stopped sheet articles in the collectors; and selectively releasing and thereby delivering stopped sheet articles for further handling.

5 Claims, 4 Drawing Sheets

METHOD OF SEPARATING SHEETS

This is a continuation of application Ser. No. 07/686,363, filed Apr. 17, 1991, now abandoned, which, in turn, is a division of Ser. No. 07/401,743, filed Sep. 1, 1989, now U.S. Pat. No. 5,025,609.

BACKGROUND OF THE INVENTION

1. Field of the Invention

This invention relates to sheet handling machines, for instance machines that handle sheets of paper and articles of similar sheet-like materials in plain and/or folded form.

2. Prior Art and Other Considerations

In paper handling, for example for mass-mailing purposes, it is often needful and advantageous to produce, handle, and convey various paper articles (imprinted or plain) through machines in parallel. For instance, paper from a roll of continuous paper, while being unrolled, may be cut off transversally and slit longitudinally into side-by-side parallel sheets for further handling. In another example, larger sheets need be slit into halves along a line that is in line with the transport direction while sheets are being conveyed. In this respect for instance, larger sheets may be transversally folded in a folding machine, and the folded sheet may be slit into two folded articles along a line parallel with the transport direction. Thereafter, the two side-by-side parallel articles need to be conveyed to further handling and utilization equipment.

In such handling in general, the need arises to separate the paper articles from one another laterally in order to facilitate further independent handling and to avoid mutual interference of adjoining lateral edges. Moreover, it is necessary and advantageous in most such situations to separate these articles in a manner assuring parallel alignment, absence of skew, and definite transverse displacement locations subsequent to their separation operation to facilitate further handling.

Whereas lateral offset or displacement motions during conveying have been employed in sheet paper article handling in the past, such motions obtainable with conventionally utilized mechanisms have not been entirely satisfactory in situations requiring parallel lateral displacements while achieving specific positional alignments. Conventionally utilized mechanisms have provided lateral article displacements without being capable of assuring absence of significant skewing motions. Consequently, article realignment subsequent to its displacement had to be performed. Such realignment or reorienting has mostly relied on forcing the article onto and along a registration rail.

For example, so-called cross-carriers are known for shifting of paper articles laterally (with respect to their conveying motion) against a registration rail to obtain alignment therewith. Such cross carriers generally employ a plurality of long cylindrical rollers or flat belts upon which the articles are conveyed. These rollers or belts are tilted and angled to gradually move articles against and then along a registration rail in the direction of their conveying motion. Generally, the articles are held down upon the rollers or belts by freely revolving idler balls to assure attainment of the desired registration alignment and to avoid skewing due to friction effects along the rails. It will be appreciated that motions of articles are not exactly repeatable in such arrangements, particularly due to retarding friction along the rails.

Moreover, paper articles having an adverse edge aspect ratio, i.e. having short lateral edges in relationship to the length of the edges directed along the direction of the main conveying motion, are difficult, if not impossible, to align with a stationary registration rail and keep aligned therewith while sliding therealong. Such paper articles, rather than becoming reliably and repeatably aligned along the rail, tend to skew further, and even tend to tumble over onto their longer edge along the rail under some circumstances.

The device of the present invention is intended to overcome the above-discussed difficulties and to provide for reliable and repeatable parallel paper article separation and alignment thereafter even (and particularly) for paper articles being handled and conveyed with an adverse edge aspect ratio.

An overall feature of the invention is the provision of a sheet separator device for transversely separating sheets being conveyed thereto and therethrough in a common plane in parallel side-by-side relationship, whereby the sheets are transversely displaced without incurring a significant skew and whereby the sheets reliably attain a repeatable alignment and transverse position.

SUMMARY OF THE INVENTION

In accordance with principles of the present invention, a sheet separator device comprises first and second endless belt arrangements, each including a plurality of upper and lower belts for capturing and conveying in the nip therebetween a sheet article. A plurality of nip roller pairs serve to feed paper sheet articles in a plane in parallel side-by-side relationship to the nip between the belts.

The directions of the conveying motions of first and second endless belt arrangements are divergently angled with respect to one another, so that the transport paths of paper articles supplied thereto along parallel paths diverge while the articles are conveyed by the belt arrangements. A further plurality of nip roller pairs serves to capture the separated articles leaving the nip between the upper and lower belts and to further convey the articles along spaced apart or separated parallel paths in a direction that is substantially parallel with the original direction in which the articles were fed to the nip between the belts.

Thus sheet articles are separated irrotationally (without incurring skew) and remain substantially aligned parallel with the conveying direction. The lateral displacement or separation operation of the articles is under substantially positive control, as articles are continuously positively nipped between belts or nip rollers. The achieved lateral displacement is, consequently, reliably repeatable and not subject to uncontrollable influences.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
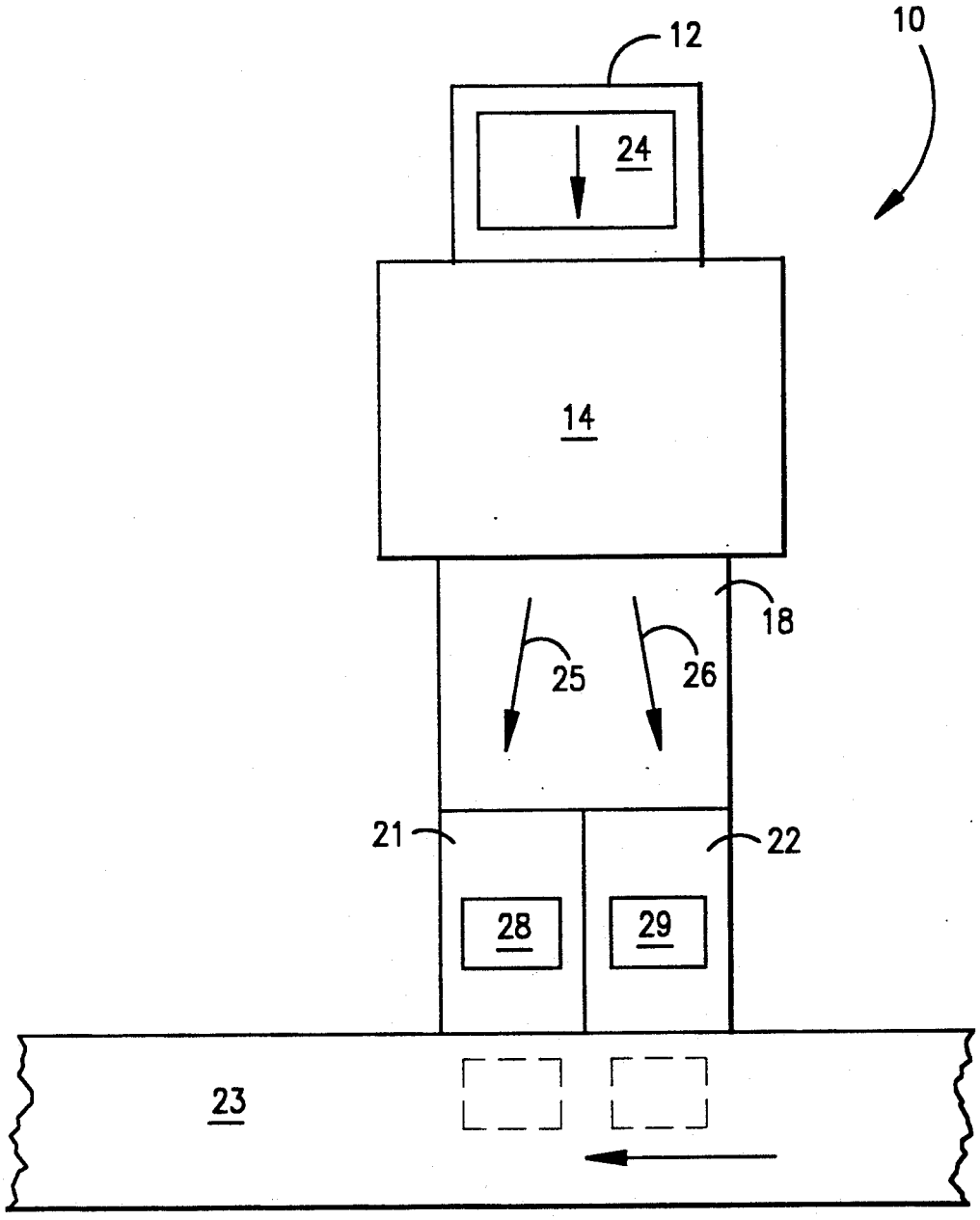
FIG. 1 is a schematic block diagram of equipment including a sheet separator device according to the present invention.

Referring now to FIG. 1, schematically depicted therein is a block diagram (akin to a plan view) of an embodiment of the invention showing an equipment assembly 10 comprising a sheet feeder 12, a folding apparatus 14, a sheet separator device 18 including here not specifically shown slitting means, first and second collector means 21 and 22, and a conveyor device 23.

Sheet feeder 12 is supplied with sheets 24 and feeds individual sheets seriatim into folding apparatus 14. Sheets are folded along folding lines which are transversely oriented with respect to the transport motion of the sheets in folding apparatus 14. Folding apparatus 14 is preferably a buckle folder, but can be any other conventional sheet folding device. Folded sheets are slit thereafter in slitting means along a cut line parallel to the transport motion of the sheets while leaving folding apparatus 14 and entering sheet separator device 18. The resulting folded and slit sheets or sheet articles are separated in sheet separator device 18 via divergent transport paths indicated here by arrows 25 and 26. The sheet articles are further transported thereafter to first and second collector means 21 and 22, respectively. For example, first and second sheet articles 28 and 29 are shown here disposed in first and second collector means 21 and 22, respectively.

Conveyor device 23, having a conveying motion substantially perpendicular to the transport motion of sheet articles to collectors 21 and 22, receives selectively delivered sheet articles 28 and 29 from collector means 21 and 22, respectively.

Figure 2:
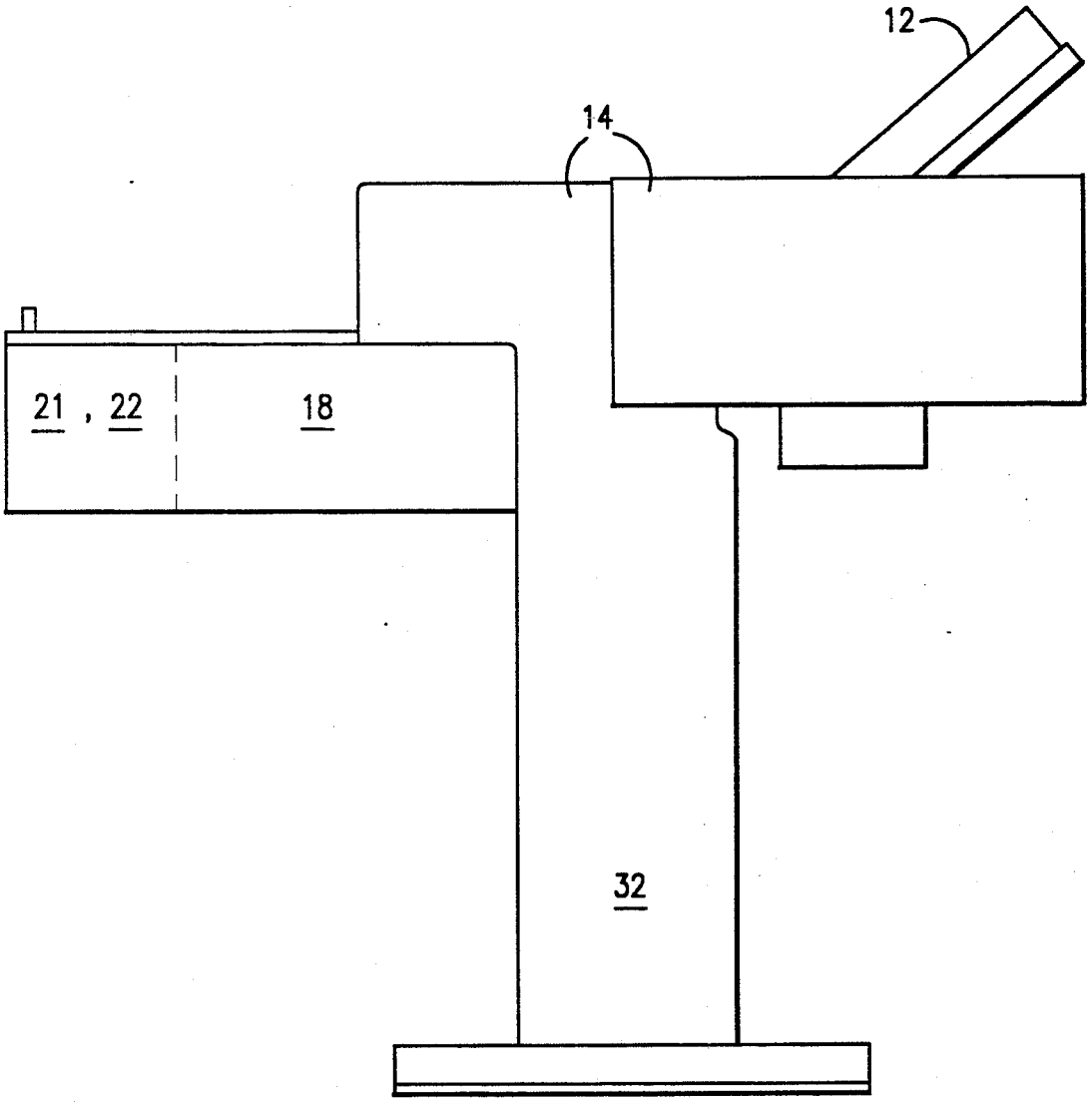
FIG. 2 is a schematic side view of a portion of the equipment indicated in FIG. 1.

FIG. 2 depicts schematically in side elevation the portion of equipment assembly 10 (of FIG. 1) including sheet feeder 12, folding apparatus 14, sheet separator device 18, and collector means 21 and 22. This equipment is shown here assembled and carried by a pedestal 32.

Figure 3:
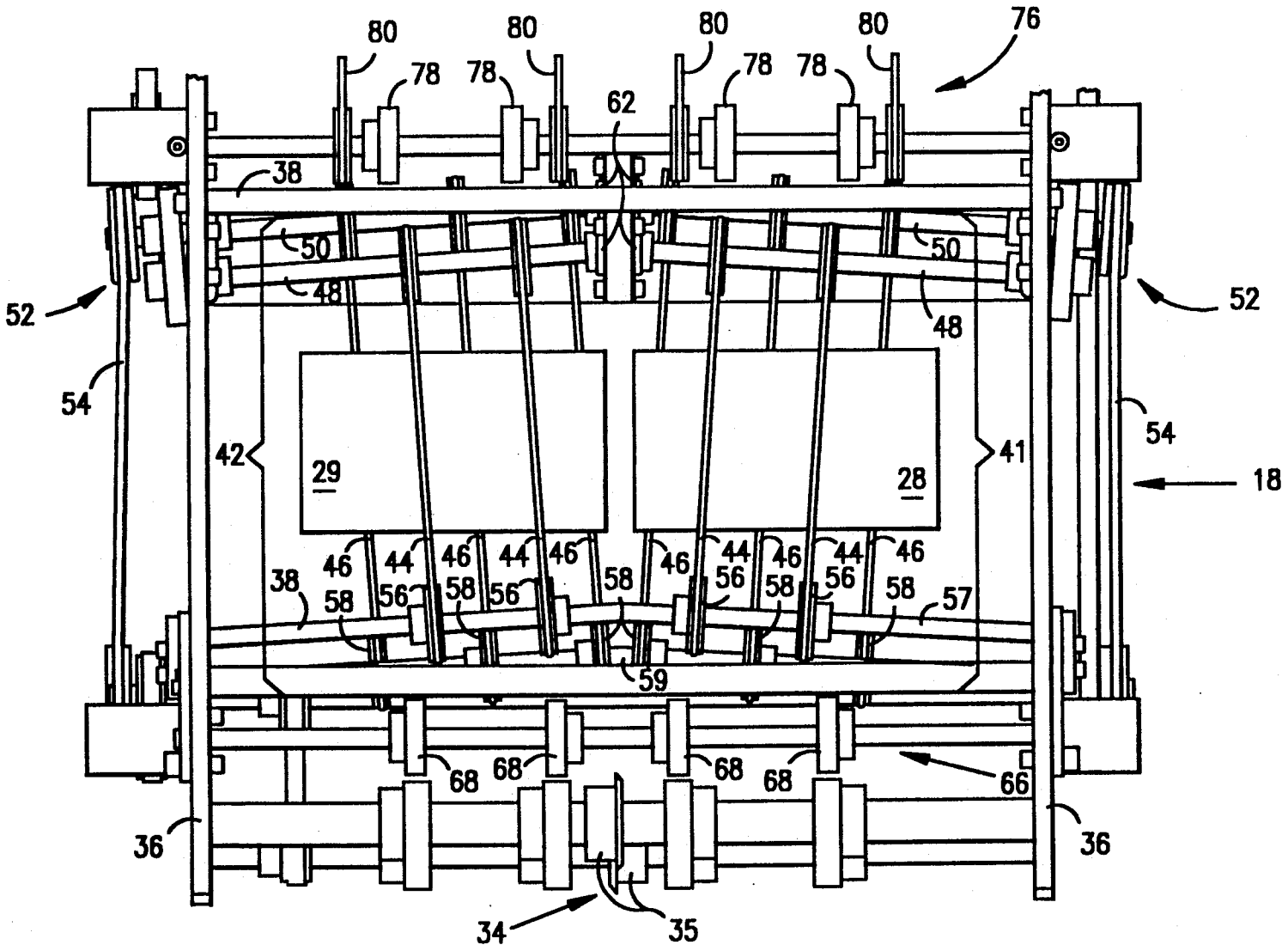
FIG. 3 is a schematic fragmented top view of a portion of a sheet separator device included in the equipment shown in FIGS. 1 and 2.

FIG. 3 illustrates in a top view the mechanisms included within sheet separator device 18 in a preferred embodiment of the invention. Also depicted here is a portion of a slitting means 34 including slitting rolls 35.

The mechanisms shown in FIG. 3 are mounted within a machine frame represented here by substantially parallel frame members 36 and joining members 38. First and second belt arrangements 41 and 42 are disposed substantially between frame members 36. Each of the belt arrangements 41,42 comprises a plurality of endless upper belts 44 and a plurality of endless lower belts 46 which are laterally spaced in alternating order. Each of the belt arrangements 41,42 comprises an upper drive shaft 48 for driving of upper belts 44 via pulleys mounted thereon and a lower drive shaft 50 for driving of lower belts 46 via pulleys mounted thereon. Common drive means 52 for driving upper and lower drive shafts 48,50 are disposed on the outsides of frame members 36. For example, as shown, mutually meshing gears are mounted on the ends of drive shafts 48,50, and one of these drive shafts (for instance as shown, drive shafts 50) on each outer side of each frame member 36 is also provided with a pulley that is belt driven via belts 54 driven from a common drive (here not further shown).

Individual drive shafts 48 and 50 (one upper and one lower for each of the two belt arrangements 41,42) are each born in an angled bearing mounted in frame members 36 at one end of the shafts and in an angled self-aligning bearing disposed approximately centered between frame members 36 in an approximate location indicated by the numeral 62.

Upper idler pulleys 56 are born on a common upper axle 57 and lower idler pulleys 58 are born on a common lower axle 59. Axles 57 and 59 are irrotationally mounted in frame members 36 and are provided with an angle bend that is disposed half-way between frame members 36.

First and second belt arrangements 41,42 are divergently angled with respect to one another (in the horizontal plane of FIG. 3) and are substantially identical but side-reversed in mirror-image manner reflected about a vertical central plane, as shown. Each one of the plurality of endless upper belts 44 has a lower reach extending between upper drive pulleys and upper idler pulleys 56. Each one of the plurality of endless lower belts 46 has an upper reach extending between lower drive pulleys and lower idler pulleys 58.

Endless upper and lower belts 44 and 46 are driven so that their lower and upper reaches, respectively, move in the same direction at the same speeds. As will be more clearly seen in the depiction of FIG. 4, upper and lower reaches within each belt arrangement 41 and 42 are parallel to one another. However, the orientation of the upper and lower reaches of first belt arrangement 41 is angled with respect to the orientation of the upper and lower reaches of the second belt arrangement 42 in the approximate plane of the reaches; an acute angle is subtended therebetween, so that the travel motions of the respective reaches of first and second belt arrangements diverge in the direction of motion.

Also illustrated in FIG. 3 are first and second sheet articles 28 and 29, respectively, while being conveyed irrotationally side-by-side, but divergently, between upper and lower reaches of first and second belt arrangements 41 and 42, respectively. Upper and lower reaches in each belt arrangement are disposed with respect to one another in slightly overlapping relationship so that sheet articles 28 and 29 are nipped therebetween and positively held thereby in a slightly distorting wave-like strained manner between upper and lower reaches. This form of nipping also provides further stability to the sheet articles against buckling or roll-up particularly in the direction of conveying motion.

A sheet article is delivered to a belt arrangement at an entry thereto which is the region wherein a sheet article is first nipped between upper and lower reaches. A sheet article leaves a belt arrangement at an exit therefrom which is the region to which the belt arrangement conveys the sheet article and where it is last nipped between upper and lower reaches. Entries and exits will be more clearly seen in FIG. 4.

FIG. 3 also shows feed means 66 comprised of a plurality of parallel nip roller pairs 68 spaced along parallel shafts 70 having at least one roller of each pair driven via its shaft from a here not shown drive. Feed means 66 is so arranged that it feeds and delivers sheet articles side-by-side and parallel to entries of the belt arrangements 41 and 42, respectively.

Further shown in FIG. 3 are transporting means 76 comprised of a plurality of parallel nip rollers pairs 78 spacedly arranged along parallel shafts having at least one roller of each pair driven via its shaft from a here not specifically shown drive. Transporting means also comprises a plurality of driven guide belts 80 for further guiding sheet articles delivered to and transported by nip roller pairs 78 farther. Transporting means 76 is so arranged that it feeds and transports sheet articles (received from exits of belt arrangements 41 and 42) in parallel, but spaced apart by the action of the preceding diverging belt arrangements 41 and 42.

First and second articles 28 and 29, shown in FIG. 3, were produced by slitting or cutting of a single original sheet article that has been fed through slitting means 34 and that has been cut longitudinally in line with the direction of feeding by slitting rolls 35. The original sheet article can be cut into equal halves, as indicated here, or into unequal portions, provided the shown mechanisms are appropriately adapted. In the embodiment of the sheet separator device of the invention in combination with a folding apparatus, the original sheet article (as sheet 24 in FIG. 1, for instance) is initially folded in folding apparatus 14 and the folded article is slit in slitting means 34 and further fed through sheet separator device 18 in form of the separate sheet articles 28 and 29 (FIG. 3).

Figure 4:
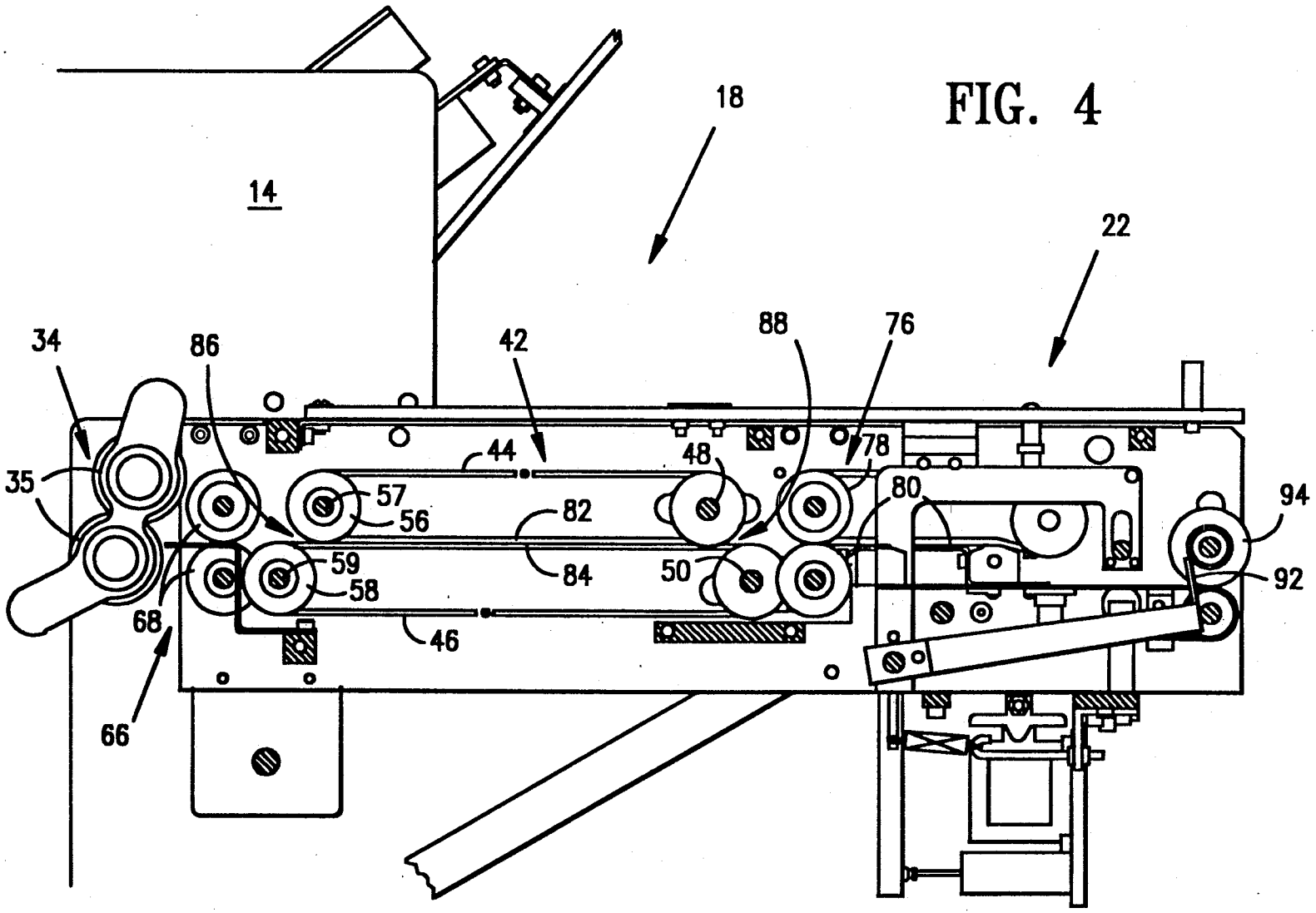
FIG. 4 is a schematic fragmented vertical center section side view of a portion of the sheet separator device shown in FIG. 3, and further showing a main portion of a collector indicated in FIG. 1.

Referring now to FIG. 4, sheet separator device 18 is shown together with second collector means 22 in sectional view, and the combination is depicted in relationship to an outlined portion of folding apparatus 14. Slitting means 34, having slitting rolls 35, is disposed in the folded sheet article transport path (from left to right) between folding apparatus 14 and sheet separator 18. Toward the right of slitting means 34 is disposed feed means 66 including a representative nip roller pair 68. Representative belts 44 and 46 (of the plurality of endless upper and lower belts, respectively) of second belt arrangement 42 are shown farther to the right. Belts 44 and 46 are carried by and between upper and lower drive pulleys (drive shafts 48,50, resp.), respectively, and upper and lower idler pulleys 56 and 58, respectively. In this FIG. 4 can now be seen the previously described (but not numbered) lower reach 82 of upper belt 44 and upper reach 84 of lower belt 46. Shown here are also an entry 86 to and an exit 88 from the region wherein sheet articles are nipped between lower and upper reaches while being conveyed by the belt arrangement 42 (and 41).

Further toward the right from belt arrangement 42 is transporting means 76 comprising nip roller pairs 78 and driven guide belt 80, the latter leading into second collector means 22.

Second collector means 22 (and identically first collector means 21) comprises a driven conveyor belt 90 and gate stop means 92 which stops further motion of articles conveyed to and deposited onto driven conveyor belt 90. Gate stop means 92 is selectively releasable by downward pivoting action so that sheet articles stopped and held thereby upon driven conveyor belt 90 are free to be selectively conveyed and delivered under pressure roller means 94 farther toward the right to further article handling means, as for instance given by conveyor device 23 shown in FIG. 1.

In use, the sheet separator device of the present invention is usually operated in combination with other equipment feeding sheet articles to the sheet separator device and/or receiving separated articles therefrom. The following describes broadly the operation of the sheet separator device 18 in an embodiment in conjunction with such other equipment as indicated in FIG. 1 by folding apparatus 14, collector means 21 and 22, and conveyor device 23.

In operation, sheets 24 are fed through folding apparatus 14, are folded therein, and are delivered via slitting means 34 to sheet separator device 18. Folded sheets, having folds transverse to the direction of their delivery to slitting means 34, are slit or cut in slitting means 34 into two individual articles along a cut that is in line with the direction of their delivery to and travel through slitting means 34. In order to facilitate further handling, particularly also individual handling, these articles need to be separated or spaced apart along the cut line by a definite lateral distance to new laterally spaced locations and parallel travel paths without incurring rotation. This is achieved in sheet separator device 18, wherein each of the two articles 28,29 delivered thereto side-by-side adjacently along parallel paths is nipped and conveyed by one of two belt arrangements 41,42 having mutually divergent conveying paths, and is substantially irrotationally displaced laterally away from the mutual cut line (as indicated in FIG. 3). The two articles 28,29 are delivered by the two belt arrangements 41,42 to transporting means 76 which transports them farther again along mutually parallel paths which, however, are farther spaced apart than the parallel paths along which the articles had been delivered from slitting means 34 via feed means 66 to entries 86 of first and second belt arrangements 41 and 42.

As indicated in FIG. 1 and more particularly shown in FIG. 4, first and second articles delivered from first and second belt arrangements 41 and 42, respectively, and farther transported via transporting means 76 are deposited in first and second collector means 21 and 22, respectively. Collector means 21 and 22 selectively hold (temporarily) or selectively release these articles to be delivered to further article handling means in accordance with desired timing requirements.

As indicated in FIG. 1, such further article handling means can be a conveyor device that conveys articles deposited thereupon in a direction that is substantially perpendicular to the direction of delivery thereto from collector means 21 and 22. Consequently, articles selectively released and delivered from collector means 21 and 22 can be selectively deposited upon conveyor device 23 in any desired order and spacing along the direction of conveying motion thereof. Conveyor device 23 can be also an intermittent feed conveyor having discrete registration locations for receiving articles to facilitate their further handling, for instance in an inserting apparatus for inserting the articles into envelopes. Conveyor device 23 can also be an input conveyor comprised in a mail handling apparatus for preparation operations of the articles for mailing without being inserted into envelopes. For example, such preparation operations can include imprinting and closure or sealing of folds for direct mailing use thereafter.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A method for in-plane separation of at least two mutually unconnected sheet articles that are transported along mutually-laterally-adjacent, in-plane paths, each sheet article having a straight lateral edge along an entire side thereof which is oriented in the direction of overall transport motion and which faces toward the laterally-adjacent inplane path, said method comprising the steps of:

feeding first and second unconnected sheet articles parallel to one another to first and second mutually divergent belt arrangements, respectively;

driving the first and second mutually divergent belt arrangements continuously at substantially common speeds;

conveying divergently in relation to one another the first and second unconnected sheet articles to a transporter, said step of conveying divergently being effected in a common plane and being performed in the first and second mutually divergent belt arrangements, respectively;

separating the first and second unconnected sheet articles in the common plane substantially irrotationally so that lateral separation therebetween is increased while said step of conveying divergently is performed; and transporting the unconnected sheet articles by said transporter in side-by-side parallel relationship and, thereafter, further handling the unconnected sheet articles, wherein said step of transporting includes the steps of:

receiving, capturing, and nipping the unconnected sheet articles in a plurality of nip roller pairs immediately subsequent to said steps of conveying divergently and separating;

positively feeding the unconnected sheet articles in and by the plurality of nip roller pairs in parallel relationship toward first and second collectors, respectively;

selectively stopping first and second unconnected sheet articles upon continuously driven belts by selectively releasable gate means in first and second collectors, respectively;

collecting selectively-stopped, unconnected sheet articles in the respective collectors; and, selectively releasing and thereby delivering stopped, unconnected sheet articles from respective collectors for said step of further handling.

2. The method according to claim 1, wherein said step of conveying divergently includes nipping the first and second unconnected sheet article, respectively, between a plurality of lower and upper reaches included in each of the first and second mutually-divergent belt arrangements, respectively, and thereby continuously gripping and conveying the unconnected sheet articles in the direction of the respective one of said first and second mutually divergent belt arrangements.

3. The method according to claim 1, wherein said step of further handling includes conveying the unconnected sheet articles on a conveyor in a direction that is substantially orthogonal to the direction of motion of the unconnected sheet articles during said delivering step.

4. The method according to claim 3, wherein said step of conveying includes intermittently conveying the unconnected sheet articles on the conveyor.

5. The method according to claim 1, including guiding the unconnected sheet articles by a plurality of driven guide belts in parallel relationship to said first and second collectors, respectively, said step of guiding being effected during a portion of said feeding step and subsequently thereto.

* * * * *

UNITED STATES PATENT AND TRADEMARK OFFICE

CERTIFICATE OF CORRECTION

PATENT NO. : 5,178,383

DATED : January 12, 1993

INVENTOR(S) : James R. Moser, et al

It is certified that error appears in the above-indentified patent and that said Letters Patent is hereby corrected as shown below:

Column 8, line 16, Claim 2, "article" should read --articles--.

Signed and Sealed this

Twenty-eighth Day of December, 1993

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,178,383

DATED : Jan. 12, 1993

INVENTOR(S) : James R. Moser, Easton; Gerald D. Warden, Bethlehem; Thomas E. Bieber, Coplay, all of PA.

It is certified that error appears in the above-identified patent and that said Letters Patent is hereby corrected as shown below:

Claim 1 should be amended to read as follows:
A method for in-plane separation of at least two mutually unconnected sheet articles that are transported along mutually-laterally-adjacent, in-plane paths, each sheet article having a straight lateral edge along an entire side thereof which is oriented in the direction of overall transport motion and which faces toward the laterally-adjacent inplane path, said method comprising the steps of:

feeding first and second unconnected sheet articles parallel to one another to first and second mutually divergent belt arrangements, respectively, each of said mutually divergent belt arrangements comprising a plurality of endless belts said endless belts being oriented parallel to one another;

driving the first and second mutually divergent belt arrangements continuously at substantially common speeds, said step of driving including moving said endless belts of each of said divergent belt arrangement parallel to one another in the same direction at common speeds;

conveying divergently in relation to one another the first and second unconnected sheet articles to a transporter, said step of conveying divergently being effected in a common plane and being performed in the first and second mutually divergent belt arrangements, respectively;

separating the first and second unconnected sheet articles in the common plane substantially irrotationally so that lateral separation therebetween is increased while the orientation of the unconnected sheet articles remains unchanged, said step of separating being performed during said step of conveying divergently; and transporting the unconnected sheet articles by said transporter in side-by-side parallel relationship and, thereafter, further handling the unconnected sheet articles, wherein said step of transporting includes the steps of:

UNITED STATES PATENT AND TRADEMARK OFFICE

CERTIFICATE OF CORRECTION

PATENT NO. : 5,178,383

DATED : Jan. 12, 1993

INVENTOR(S) : James R. Moser, Easont; Gerald D. Warden, Bethlehem; Thomas E. Bieber It is certified that error appears in the above-indentified patent and that said Letters Patent is hereby corrected as shown below:

receiving, capturing, and nipping the unconnected sheet articles in a plurality of nip roller pairs immediately subsequent to said steps of coveying divergently and separating;

positively feeding the unconnected sheet articles in and by the plurality of nip roller pairs in parallel relationship toward first and second collectors, respectively;

selectively stopping first and second unconnected sheet articles upon continuously driven belts by selectively releasable gate stop means in first and second collectors, respectively;

collecting selectively-stopped, unconnected sheet articles in the respective collectors; and, selectively releasing and thereby delivering stopped, unconnected sheet articles from respective collectors for said step of further handling.

Signed and Sealed this

Twenty-ninth Day of March, 1994

*Attest:*

Bruce Lehman

BRUCE LEHMAN

*Attesting Officer*

*Commissioner of Patents and Trademarks*